United States Patent [19]

Lutts

[11] 4,214,647

[45] Jul. 29, 1980

[54] AUTOMATIC RAIL GREASING APPARATUS

[76] Inventor: William M. Lutts, 3819 Valley Ridge Dr., Nashville, Tenn. 37211

[21] Appl. No.: 880,765

[22] Filed: Feb. 24, 1978

[51] Int. Cl.[2] ..... B61K 3/00

[52] U.S. Cl. ..... 184/3 A

[58] Field of Search ..... 184/3 A, 7 R, 7 CR; 138/40, 44

[56] References Cited

U.S. PATENT DOCUMENTS

| | | | |
|---|---|---|---|
| 1,883,148 | 10/1932 | Warr | 184/3 A |
| 1,977,755 | 10/1934 | Dudley | 184/3 A |
| 1,994,460 | 3/1935 | Bijur | 138/40 X |
| 2,173,654 | 9/1939 | Moore | 184/3 A |
| 2,238,732 | 4/1941 | Huber et al. | 184/3 A |
| 2,271,146 | 1/1942 | Norris | 138/40 X |
| 2,272,774 | 2/1942 | McGarry | 184/3 A |
| 2,272,775 | 2/1942 | McGarry | 184/3 A |
| 2,729,306 | 1/1956 | Davis | 138/40 X |
| 2,938,756 | 5/1960 | Loeb | 184/7 CR X |
| 3,051,262 | 8/1962 | Bettison | 184/3 A |

*Primary Examiner*—David H. Brown

*Attorney, Agent, or Firm*—Maky, Renner, Otto & Boisselle

[57] ABSTRACT

The automatic rail greasing apparatus in accordance with the invention applies metered quantities of grease-like lubricant to the rails of a railroad track to lubricate the same as the wheels of a train pass therealong. A sensing device senses the number of train wheels passing a location on the track, and in response to the counting of a predetermined number of wheels an electronic controller periodically opens a fluid valve to pass a metered quantity of such lubricant from a pressurized reservoir to a manifolded delivery mechanism for delivering metered quantities of lubricant to a plurality of discrete spaced-apart locations on each rail. The lubricant may be passed directly through an opening in the rail head from the rail web and base side thereof to the top surface thereof on which the train wheels roll. A novel flow restrictor facilitates uniform application of grease to the multiple dispensing locations, and a dispensing reservoir formed in the rail assures dispersion of the grease on the rail head surface while avoiding undesirable back pressure into the dispensing outlets as the train wheels pass thereover.

13 Claims, 8 Drawing Figures

OPEN
CLOSE
FROM GREASE RESERVOIR

AUTOMATIC RAIL GREASING APPARATUS

BACKGROUND OF THE INVENTION

The present invention relates generally, as indicated, to an automatic rail greasing apparatus and, more particularly, to such an apparatus that dispenses metered quantities of lubricant directly to the work surface of a rail in response to the number of wheels or the like passing on such rail.

In modern railroad yards in which the cars of one or more trains are divided to make up several other trains, there is a hump located at a high elevation relative to other parts of the yard. At the hump there may be, for example, two main tracks which divide many times while passing in a descending direction in the yard, for example, to form sixty or more classification tracks, as is, of course, well known.

Ordinarily the larger the number of classification tracks, the sharper are the curves in the tracks that a car must follow as it descends down the hump to the lower classification levels in the yard. It has been found that as the curves increase in sharpness, the number of cars that jump the track or derail also increases. However, slowing the cars reduces the overall efficiency of the yard and, therefore, is undesirable. Also, slowing the cars too much as they approach the area of coupling with another car, say near the end of a classification track, may prevent the car from reaching the intended end of its run to effect such coupling.

One technique for improving safety in railroad yards, i.e. by reducing the number of derailments, has been to reduce the speed of the cars as they come down the hump, either by reducing the angle of the slope of the hump or by increasing the number of mechanical retarders or the amount of retardation effected by existing retarders that slow the cars as they come down the hump.

One reason for such derailments has been found to be the relative inability of the railroad car wheels to slide laterally on the tracks as they pass on a curve. Therefore, one technique used in the past to facilitate such lateral sliding has been to form a long, for example six feet or so, groove in the top crown or work surface of the head of the rail, which is supported by the web and the base of the rail, and to pump oil, which is relatively non-viscous into the groove to lubricate the wheels passing thereover. There are a number of disadvantages with such a system, though. For example, the relatively light weight and non-viscous oil has been found to pour over the rail or to be picked up and blown by wind with the result in either case being a polluting of the local environment, including possibly destruction of vegetation and/or polluting of water in adjacent drainage ditches. Moreover, the grooves in the rail may encounter blockages, for example from dirt, ice, or other obstructions, thus making them relatively ineffective to lubricate wheels passing thereover.

The inability of a train wheel to slide on the top surface of a rail head as it passes on a curved track section, and especially on the so-called low-side rail, may cause extremely large forces on the rail, on the one hand, possibly destroying the rail, on the other hand, adversely slowing the car. This slowing effect may vary with weather conditions, e.g. a wet rail will not slow a car as much as a dry one, and such unpredictability of rail-wheel friction coefficient, then, requires, undesirably, excessively subjective control of retarders in a yard or train operation on a line. It is, accordingly, desirable to predictably improve and maintain the rollability of train cars and wheels thereof particularly on non-linear track sections.

SUMMARY OF THE INVENTION

In accordance with the present invention a metered quantity of relatively high viscosity grease-like lubricant is delivered directly to the top or work surface of the rail head to lubricate the same. In accordance with one aspect of the invention, the lubricant is delivered directly through the rail head to the top surface, thus effecting lubrication of the critical area of the rail head to facilitate lateral sliding of the lubricated wheels on the track. Accordingly, the yard may be operated in a safe and efficient manner by minimizing derailments while the cars still are permitted to travel at relatively high speeds by assuring good rollability of the wheels and cars. Moreover, the relatively high viscosity grease-like lubricant, which, it has been discovered, satisfactorily lubricates the rails and/or wheels, will not blow in the wind or ordinarily pour off the rails and, accordingly, will not pollute the local environment. Also, the relatively minimum or non-excessive amount of lubricant dispensed ordinarily will not impede the effectiveness of the retarders, which usually slow the descending cars sufficiently so they collide with and couple to awaiting cars on the classification tracks at satisfactorily slow speeds of, for example, 2 to about 4 mph. Further, when depositing such lubricant beyond or down hill of the last regarders on a yard classification track, for example, predictable rollability is obtained with a corresponding predictably controlled operation of such retarders.

In accordance with another aspect of the invention, the relatively high viscosity grease-like lubricant is delivered to the rail or rails under relatively high pressure to assure such delivery even in the face of adverse conditions, such as, for example, cold, wet, or relatively dirty environments, which might otherwise increase the probability of a blockage at the outlet of the lubricating mechanism.

According to still another aspect of the invention, metered quantities of grease-like lubricant are applied to a number of discrete, spaced-apart locations along one or both rails of a track to assure adequate, but not excessive, distribution of lubricant on the mating wheels and track, and in accordance with a further aspect, the invention provides automatic train detection and periodic dispensing of metered quantities of lubricant in dependence on the number of wheels passing the lubricated track section. Moreover, the several areas at which the lubricant is dispensed to the track have controlled flow orifices that assure relatively uniform amounts of lubricant are dispensed to each location. Also, according to an important aspect of the invention, relatively accurate flow and/or pressure control of the lubricant is selectively facilely provided upstream of the dispensing flow orifices to assure uniform dispensing along the rail. Further, groove-like reservoirs in the rail head facilitate spreading of lubricant while avoiding back pressure into the dispensing flow orifices.

With the foregoing in mind, it is a primary object of the invention to provide an automatic rail lubricating apparatus that is improved in the noted respects.

Another object is to improve the safe and effecient operation of railroad yards, especially those having relatively high density arrangement of tracks.

An additional object is to lubricate a rail or rails of a track, such as a railroad track, and preferably to effect such lubricating automatically and with a minimum of polluting or other detrimental effects on the local environment.

A further object is to lubricate a track uniformly over a length thereof.

Still another object is to improve the reliability and durability of rail lubricating systems.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail a certain illustrative embodiment of the invention, this being indicative, however, of but one of the various ways in which the principles of the invention may be employed.

DESCRIPTION OF THE PREFERRED EMBODIMENT

Figure 1:
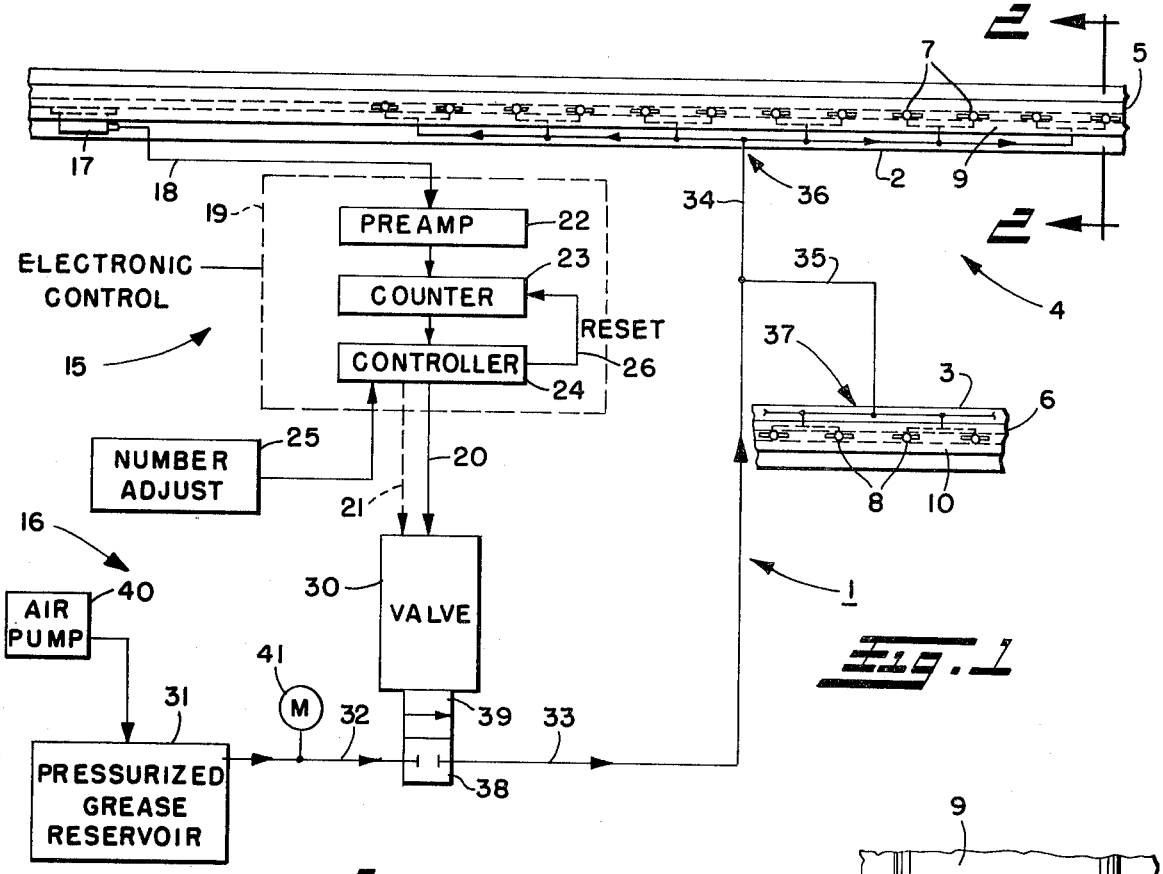
FIG. 1 is a schematic illustration of the automatic rail greasing apparatus in accordance with the invention as applied to the parallel rails of a typical railroad track.

Referring now more particularly to the drawings, and initially to FIG. 1, an automatic rail greasing apparatus is generally indicated at 1 in association with the rails 2, 3 of a railroad track 4 to deliver metered quantities of grease-like lubricant directly to discrete spaced apart locations on the rails. In the preferred embodiment of the invention, the grease-like lubricant is a relatively high viscosity grease that is delivered directly through the heads 5, 6 of the rails through lubricant dispensing openings 7, 8, an illustrative opening 7 being seen more clearly in FIG. 2 to the top or work surfaces 9, 10 of the rails. Each of the openings 7, 8 is located at discrete spaced-apart locations along the rail, for example at 1 foot intervals over a 12 ft. distance. When the automatic rail greasing apparatus 1 is operative, for example in response to detection of a train moving from left to right, as illustrated, metered quantities of grease delivered to the top or work surface 9, 10 of each rail head are picked up and spread by the train wheels rolling along the track 4.

Thus, in operation of the automatic rail greasing apparatus 1, controlled quantities of grease are applied to the rails in sufficient amounts to effect satisfactory lubrication of the rails and wheels, thereby facilitating the ability of the wheels to slide laterally as they pass around curves that are greased by the invention or have adjacent straights greased thereby. Derailments are, accordingly, reduced while the yard is utilized at high efficiency with cars traveling down the hump at relatively fast speeds. The relatively high viscosity grease is relatively non-polluting, especially in comparison to the much lower viscosity oil previously used. Only minimum amounts of grease are required and, therefore, the retarders and the like ordinarily further down the track from the automatic rail greasing apparatus 1 will not be impeded in their normal operation of slowing the descending cars. Also, when the apparatus 1 is down hill of the retarder(s) it assures reliable rollability to facilitate the controlled operation of the retarders without the need, for example, to provide extreme compensation as track conditions vary, say, from wet to dry, thus changing the frictional forces between the wheels and rails.

In the automatic rail greasing apparatus 1 a detector 15 detects the presence of a train on the track and in response to such detection operates a lubricator 16 that delivers grease to the individual rails. The detector 15 includes a conventional sensor 17, such as a magnetic flux or permeability sensing device, or the like, that produces an electrical sensor signal, which ordinarily will have a number of positive or negative going pulses with each representing a sensed train wheel passing in close proximity to the sensor, on one or more electrical lines 18. The detector 15 also includes an electronic control 19, which may be, for example, a conventional batch counter device that is adjustable to count a predetermined number of sensor signal pulses, i.e. the passage of a predetermined number of train wheels by the sensor 17, and each time count is reached, the electronic control produces a dispensing signal on one or more electrical lines 20 to operate the lubricator 16 to deliver grease. If desired, the electronic control 19 also may have a line 21 coupled to deliver a shut off signal to the lubricator 16 for positive control thereof to assure that grease is not dispensed unless specifically commanded by production of a dispensing signal on line 20.

As is illustrated, the electronic control 19, or a typical batch counter, may include one or more preamplifier or amplifier stages 22, which amplifies the sensor signal, a conventional electronic counter 23, which counts the pulses of the sensor signal and, thus, the train wheels passing the sensor 17, and a conventional controller circuit 24. The controller circuit 24 may be a conventional logic type circuit that particularly is responsive to the counter 23 reaching a predetermined number or count, which may be selectively manually set by an external adjustment 25. When the counter 23 reaches the predetermined number, the controller 24 produces the dispensing signal on line 20 to operate the lubricator 16 to dispense grease and also produces a reset signal on line 26 to reset the counter to count the next batch of sensor signal pulses or wheels up to the predetermined number again. The electronic control 19, which may have electrical power supplied thereto from a conventional external power supply, ordinarily will operate continuously and automatically to count batches of wheels passing by the sensor 17 and, accordingly, periodically to produce a dispensing signal on line 20 each time a complete batch has been counted. Although one form of electronic control 19 has been described hereinabove, it will be appreciated that other types of sensors and/or electronic control mechanisms may be employed in the detector 15 to produce periodic dispensing signals on line 20.

In the lubricator 16 a valve 30 controls the flow of grease from a reservoir 31 and pipe 32 to a delivery pipe 33, which has branches 34, 35 connected to respective manifolded dispensers 36, 37 at respective rails 2, 3. The valve 30 may be a conventional solenoid operated, fluid operated, or other conventional valve that is normally closed, as illustrated at 38, to block fluid flow between the pipe 32 and the delivery pipe 33 or that is normally positively held closed by a shut off signal on line 21 from the electronic control 19. Moreover, the valve 30 may be selectively operated in response to a dispensing signal on line 20 to close a fluid path, as indicated at 39, between the pipes 32, 33. The reservoir 31 may be a conventional grease can or other reservoir that preferably is pressurized by air from an air pump 40 to maintain a pressurized supply in the pipe 32. Preferably, the original grease can can be used as the reservoir in the system 1, without having to shovel grease from one container to another, thus reducing labor and the chance of polluting the grease. A meter 41 coupled to the pipe 32 is provided to display the pressure of the grease therein.

When a dispensing signal on line 20 opens the valve 30, a quantity of grease, the amount depending on the duration of the dispensing signal that holds the valve 30 open, for example, flows to the manifolded dispensers 36, 37 that deliver metered quantities of grease via respective delivery mechanisms to lubricate the rails, as will be described further below with reference to FIGS. 2 and 5.

Figure 2:
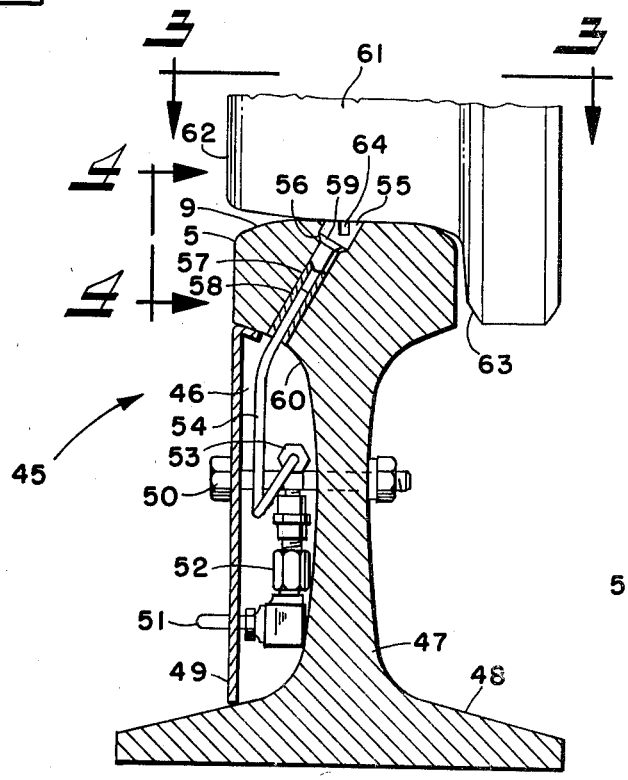
FIG. 2 is a section view looking generally in the direction of the arrows 2—2 through one of the rails of FIG. 1.

Turning now more particularly to FIG. 2, a typical delivery mechanism 45 of the manifolded dispenser 36 is positioned in a volume 46 adjacent the web 47 of the rail 2 between the base 48 and the head 5 thereof. A cover 49, for example of sheet metal or the like, which is secured to the rail by a bolt 50, holds the delivery mechanism 45 in position within the volume 46 and provides a protective shield for the manifolded dispenser 36.

Grease is delivered to an input nipple or fitting 51 of the manifolded dispenser 36 from the delivery pipe branch 34 and passes through a riser 52 to a tee connector 53. A flexible delivery tube 54, for example of copper, plastic, rubber, or other relatively flexible material to facilitate mounting of the over-all manifolded dispenser 36 relative to the rail 2 and, particularly, the openings 7, couples such opening with the tee 53. The opening 7 preferably has an enlarged outlet 55 that tapers down at a seat 56 to a cylindrical passage 57, and a tubular insert 58, for example of plastic or the like inserted fully into the cylindrical passage 57, has a flared shoulder 59 that mates with the seat 56 to facilitate proper insertion thereof. The tubular insert 58 receives the delivery tube 54, facilitates holding or connecting of the delivery tube in the opening 7 and removal for cleaning and other servicing, and delivers grease therefrom directly through the outlet 55 to the top surface 9 of the rail head 5. The use of such tubular inserts also allows the holes drilled through the rail head to be relatively large and, thusly, to be formed by a relatively large drill bit for adequate strength to penetrate the hard steel rail, as opposed to relatively smaller bits that have experienced breakage during such drilling. As a corollary, though, the size of the delivery tube may be relatively small for minimizing cost while increasing flexibility and, thus, ease of installation.

It now will be appreciated that each time valve 30 is opened, the typical delivery mechanism 45 delivers a metered quantity of grease directly through the opening 7, which extends through the rail head 5 between one side 60 facing the volume 46 and the other side at the surface 9, to the outlet 55 and the surface 9. The outlet 55 may be located approximately equidistant between the edges of the rail head to assure that grease is picked up and/or spread by the surface 61 of the train wheels 62 rolling along the rail. Such lubricating facilitates the wheel surface 61 to slide somewhat on the rail head top surface 9 as the wheel flange 63 travels effectively a longer distance while engaged with the track and proceeding around a curve than does the wheel surface 61.

Figure 3:
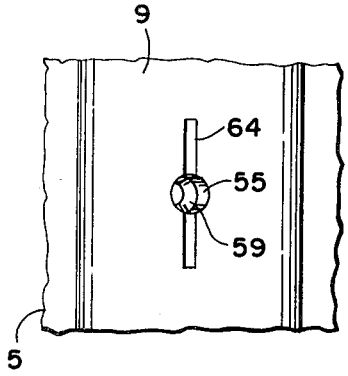
FIG. 3 is a partial top plan view of the rail head looking in the direction of arrows 3—3 of FIG. 2 with the wheel removed to show the groove-like reservoir.
Figure 4:
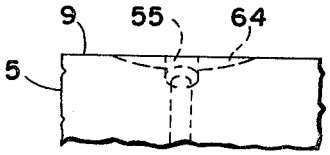
FIG. 4 is a partial side view of the rail head looking in the direction of the arrows 4—4 of FIG. 2 also to show such reservoir.

In FIGS. 3 and 4 are seen groove-like reservoirs 64 cut, for example, by a disc saw in the top surface 9 of the rail head 5 on opposite sides of the dispensing opening outlets 55 extending therethrough parallel with the track direction. The saw cut causes the reservoirs 64 to taper from a maximum depth at the outlets 55 to a minimum depth remotely therefrom. The reservoirs 64 allow grease pumped through the outlets 55 to flow away from the outlets as wheels pass thereover so the wheels do not force the lubricant back down into the outlets 55 which would create an undesirable back pressure therein. The reservoirs 64 and, especially, their tapered shape also facilitate application of lubricant to the wheels 62.

Figures 5, 6, 7, 8:
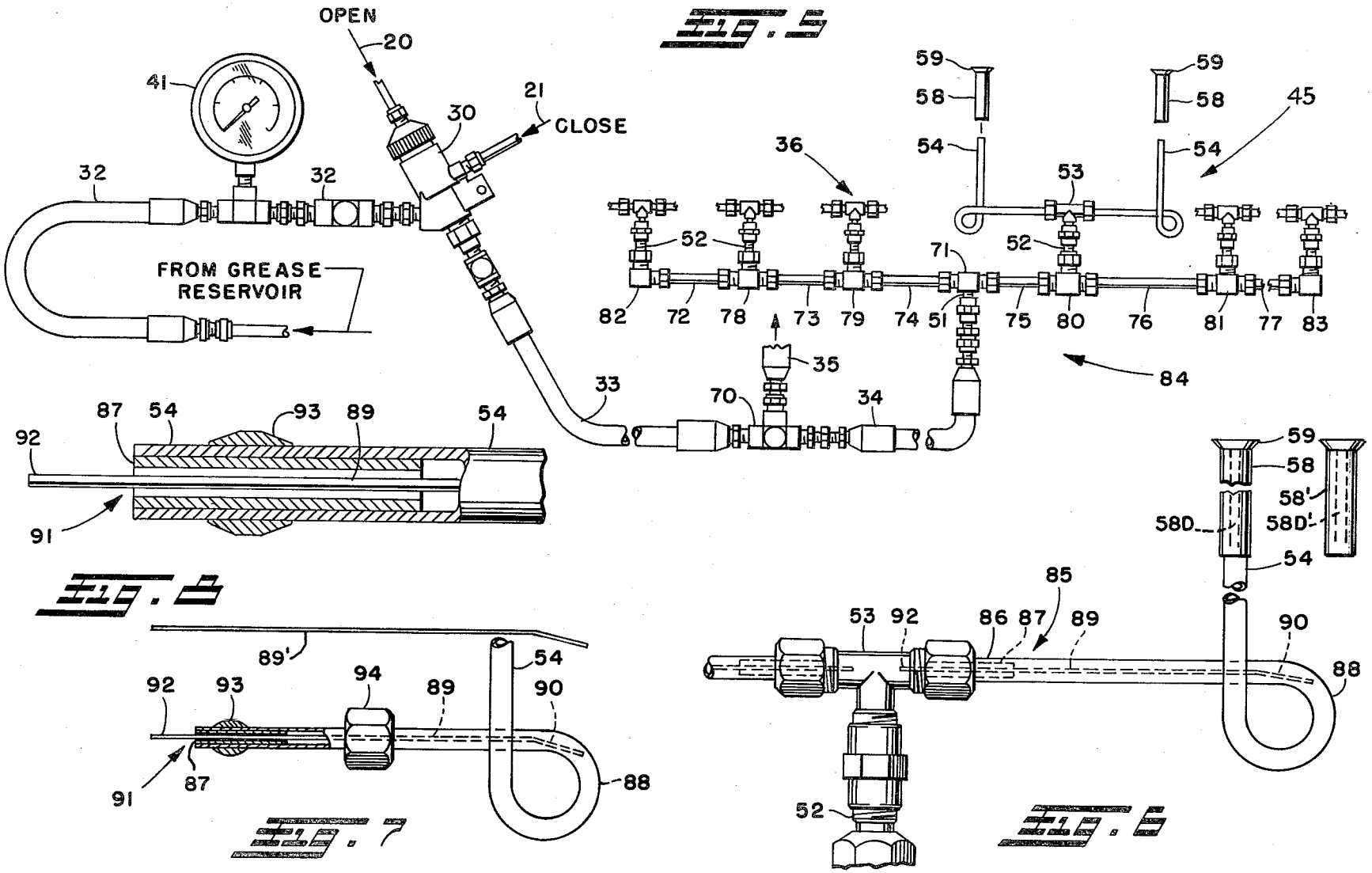
FIG. 5 is an illustration of the fluid piping arrangement for delivering metered quantities of lubricant to one of the rails of the track illustrated in FIG. 1.
FIGS. 6, 7 and 8 are partial side views, partly in section and with FIG. 8 being enlarged, of the flow restrictor of the invention.

A more detailed diagram of the piping or fluid conduit arrangement for the lubricator 16 is illustrated in FIG. 5. Grease from the reservoir passing through the pipe 32 having its pressure monitored and displayed by the meter 41 is selectively passed by the valve 30, as described above, to the delivery pipe 33, which is divided at a tee connector 70 to form the branches 34, 35. The manifolded dispensers 36, 37 may be identical and for convenience only the former will be described in detail.

Grease from the branch 34 and nipple 51 is coupled by a tee 71 to the pipes 72–77, tees 78–81, and elbows 82, 83, all of which form the respective sides of a manifold 84. Each of the tees 78–81 and elbows 82, 83 passes grease from the manifold 84 to respective risers 52, and, as was described above, respective tees 53 couple the risers to a pair of delivery tubes 54.

The tubular inserts 58 may be of differnt sizes so as to act, for example, as flow restricting orifices to assure that the metered quantities of grease simultaneously delivered to the plural outlets 55 of the openings 7 are uniform. Thus, the internal passage dimension 58D of the tubular inserts 58 associated with the delivery mechanisms 45 located proximate the manifold dividing tee 71 may be smaller than the internal passage dimension 58D' of the tubular inserts 58' (FIG. 6) associated with respective delivery mechanisms 45 that are more remotely located from the manifold delivery tee 71. Such size variation preferably compensates for the pressure drops occurring in the pipes 72 through 77, thereby to provide approximately equal metered quantities of grease at the plural openings 7 in the respective rails. Moreover, the tubular inserts 58 preferably are conveniently removable from the rail openings 7 to facilitate cleaning and/or repair of such inserts and/or of the remaining portions of the respective delivery mechanisms 45.

In FIGS. 6, 7, and 8 is illustrated the flow restrictor 85 for equalizing pressures along the manifold 84 and the amounts of lubricant dispensed through the inserts 58 and the outlets 55 to the rail head surface. At the inlet end 86 of each outlet tube 54, which may be rubber or, more preferably, copper, etc., is inserted an insert tube 87 with a relatively accurately defined inner diameter and an outer diameter to fit snugly and without substantial movement in the outlet tube 54. Extending through the insert tube 87 and down the outlet tube 54 to a curve 88 in the latter is a relatively accurately cross-section dimensioned wire 89 that has a bend or kink 90 at the downstream end near the curve 88 to secure the wire in the tube without passing further downstream therein. The accurate size of the wire 89 cooperates with the insert tube 87 to define an accurate controlled flow orifice 91. The smaller the orifice 91, the larger the flow impediment; therefore, the sizes of the orifices 91 at the tees 53 and outlet tubes 54 will vary inversely with the proximity of the respectively associated risers 52 to the manifold input nipple 51 and tee 71. For example, the smaller size (diameter) wire 89' may be inserted into the tube 87 to provide a larger orifice 91 for less of a flow impediment than that obtained using the larger wire 89. Those tees 53 and outlet tubes 54 most remote from the tee 71 may not require any such wires 89, whereas those nearest the tee 71 may require relatively large wires 89 to limit the size of orifice 91. Preferably, the wires 89 are steel piano wire which is available in accurate sizes, durable, and sufficiently rigid for the purpose. The length of insert tube 87 is important: if it is too long, the impeding function of the orifice 91 will be too large; and, if too short, the impeding function will be inadequate. The upstream end 92 of wire 89 extends beyond the ends of insert tube 87 and outlet tube 54 to facilitate removal for cleaning and/or replacement purposes, for example to vary the sizes of orifices 91 as weather conditions and/or lubricant properties vary. A compression sleeve 93 and a compression nut 94 connect the outlet tube to the tees 53 in conventional manner, as shown.

In view of the foregoing, it now will be appreciated that the automatic rail greasing apparatus in accordance with the present invention automatically provides controlled amounts of lubricant directly to one or more rails of a typical railroad track or the like to lubricate the same for the above-described and other purposes, while achieving the above-described and additional advantages of such automated relatively high viscosity lubricant dispensing technique.

I, therefore, particularly point out and distinctly claim as my invention:

1. An automatic rail lubricating system, comprising detector means for detecting the presence of a train on such rail, said detector means comprising sensing means for sensing the wheels of a train, and lubricating means responsive to such train detection for applying a metered quantity of grease-like lubricant to such rail, said lubricating means including a pressurized supply of lubricant and valve means for delivering metered quantities of lubricant to such rail, and said detector means further including control means for operating said valve means to dispense metered quantities of lubricant in response to the sensing of a predetermined number of wheels by said sensing means.

2. The system of claim 1, said control means comprising batch counter means for counting a predetermined number of wheels passing said sensing means and means for delivering a dispensing signal to said valve means to dispense such metered quantities of lubricant each time a predetermined number of wheels has been sensed.

3. A lubricating apparatus for a rail having a head with a top surface on which a wheel or the like may roll and a relatively narrower web attached to the bottom side of such head for supporting such head above a rail base, comprising lubricating means for delivering a metered quantity of lubricant directly through such rail head from the bottom side of such rail head to such top surface thereof to lubricate the same, said lubricating means including an opening extending fully through such head generally in a direction from the bottom side thereof proximate such web to such top surface for passing lubricant to the latter, and a reservoir means comprising a groove in such surface connecting with said opening for applying lubricant to wheels passing thereover without creating a forceful back pressure in said opening; said groove extending on both sides of said opening in a substantially co-directional extent with the rail.

4. The apparatus of claim 3, said groove being tapered from a maximum depth proximate said opening to a minimum depth remotely thereof.

5. An automatic rail lubricating system, comprising detector means for detecting the presence of a train on such rail, and lubricating means responsive to such train detection by said detector means for applying a metered quantity of grease-like lubricant to such rail, said lubricating means including delivery tube means for delivering lubricant from a supply thereof to such rail, a tubular insert held in said delivery tube means, said tubular insert having a relatively accurately defined inner diameter, and wire-like means also having a relatively accurately defined outer diameter positioned in said tubular insert for forming and defining therewith an orifice impeding the flow of fluid therethrough thereby to control the flow of grease-like lubricant to such surface.

6. The system of claim 5, said wire-like means comprising piano wire.

7. The system of claim 5, said delivery tube means having a curve therein, and said wire-like means having kink means therein cooperative with said curve for holding said wire-like means in place relative to said delivery tube means and said tubular insert.

8. The system of claim 5, said lubricating means including means for lubricating plural discrete spaced-apart locations on such rail, manifold means for supplying lubricant to each of such locations, supply means for supplying lubricant to said manifold means, and wherein said wire-like means at different respective flow restrictors are of different sizes to define different size orifices to provide generally uniform quantities of lubricant to such rail at such plural locations.

9. A lubricating apparatus for a rail having a head with a top surface on which a wheel or the like may roll and a relatively narrower web attached to the bottom side of such head for supporting such head above a rail base, comprising lubricating means for delivering a metered quantity of lubricant directly through such rail head from the bottom side of such rail head to such top surface thereof to lubricate the same, said lubricating means including an opening extending fully through such head generally in a direction from the bottom side thereof proximate such web to such top surface for passing lubricant to the latter, means for controllably delivering lubricant to said opening, and reservoir means in such top surface and connecting with said opening for applying lubricant to wheels passing thereover without creating a forceful back pressure in said opening, said opening and said reservoir means forming a continuous opening at such top surface, and said reservoir means comprising a groove in such top surface extending on both sides of said opening in a substantially co-directional extent with such rail.

10. The apparatus of claim 9, said groove being tapered from a maximum depth proximate said opening to a minimum depth remotely thereof in both directions of said groove.

11. An automatic rail lubricating system, comprising detector means for detecting the presence of a train on such rail and lubricating means responsive to such train detection by said detector means for applying a metered quantity of grease-like lubricant to such rail, said lubricating means including means for lubricating plural discrete spaced apart locations on such rail, manifold means for supplying lubricant to each of such locations, means for securing said manifold means to such rail, a pressurized supply of lubricant and valve means operatively controlled by said detector means for delivering metered quantities of lubricant to said manifold means, and said detector means comprising sensing means for sensing the wheels of a train and control means for operating said valve means to dispense metered quantities of lubricant in response to the sensing of a predetermined number of wheels by said sensing means.

12. A lubricating apparatus for a rail having a head with a surface on which a wheel or the like may roll and a relatively narrower web on an opposite side of such head from such surface for supporting such head, comprising lubricating means for delivering a metered quantity of lubricant directly through such rail head to such surface to lubricate the same, said lubricating means including an opening extending fully through such head generally in a direction from the web side thereof to such surface for passing lubricant to the latter, and detector means for detecting the number of wheels or the like rolling past a predetermined location on such surface; said lubricating means comprising means for lubricating plural discrete spaced apart locations on such surface, manifold means for supplying lubricant to each of such locations, a pressurized supply of lubricant, and valve means operative for delivering metered quantities of lubricant to said manifold means, and said detector means further including control means for operating said valve means to dispense metered quantities of lubricant in response to sensing of a predetermined number of wheels or the like rolling by such location.

13. A lubricating apparatus for a rail having a head with a surface on which a wheel or the like may roll and a relatively narrower web on an opposite side of such head from such surface for supporting such head, comprising lubricating means for delivering a metered quantity of lubricant directly through such rail head to such surface to lubricate the same, said lubricating means including a plurality of openings at linearly spaced-apart locations of said rail head, each extending fully through such head generally in a direction from the web side thereof to such surface for passing lubricant to the latter, tubular insert means in said openings for lining at least a portion of the latter, said tubular insert means being removable for cleaning, fluid conduit means for passing lubricant to said insert means for delivery to such surface, said insert means being of varying sizes to provide generally uniform quantities of lubricant to such surface at such plural locations, and manifold means for delivering lubricant to such fluid conduit means.

* * * * *